United States Patent [19]

Mikina et al.

[11] 4,246,861

[45] Jan. 27, 1981

[54] BUOYANT CRAFT

[76] Inventors: Stanley J. Mikina, 4782 Coquina Key Dr. SE., 440/17, Fla. 33705; John A. Mikina, 16975 Fitzgerald Ave., Livonia, Mich. 48154

[21] Appl. No.: 23,021

[22] Filed: Mar. 22, 1979

[51] Int. Cl.[3] ..... B63H 11/02; B63H 16/00

[52] U.S. Cl. ..... 440/17; 440/23; 440/38

[58] Field of Search ..... 115/11, 12 R, 14, 21, 115/25, 28 R, 29; 9/6 P

[56] References Cited

U.S. PATENT DOCUMENTS

| | | | |
|---|---|---|---|
| 3,565,032 | 2/1971 | Hertel | 115/28 R |
| 3,732,587 | 5/1973 | Fletcher | 9/6 P |

FOREIGN PATENT DOCUMENTS

| | | | |
|---|---|---|---|
| 1364274 | 12/1964 | France | 115/25 |

*Primary Examiner*—Sherman D. Basinger

*Attorney, Agent, or Firm*—William J. Ruano

[57] ABSTRACT

A buoyant craft, such as a boat or raft, propelled by a water jet thrust of high efficiency. Such thrust is provided by a wedge shaped chamber, such as one including a substantially flat plate pivotally mounted forwardly and on the underside of the craft and having two vertical sides. Pedals are provided on an extension of the flat plate. A modification involves the use of two separate wedge shaped jet thrust chambers with a common central wall to permit better steering. Still another modification involves the use of a wedge shaped chamber made of rubber or other flexible elastomer which is squeezed by pivotal movement of the pedal-operated flat plate to effect jet propulsion.

1 Claim, 5 Drawing Figures

BUOYANT CRAFT

The present invention relates to apparatus for producing a propulsive thrust on a buoyant craft in water.

In the past, various structures have been devised for mechanically propelling a buoyant craft in water, operated either by the hands or the feet of the rider or by motor. These have had the outstanding disadvantage of being relatively inefficient by requiring the expenditure of considerable physical energy for the amount of propulsive thrust obtained on the craft. Furthermore, limited speeds and acceleration have been obtained.

An object of the present invention is to overcome the above-named disadvantages and to provide a novel and highly efficient means operated preferably by the legs of the rider for propelling a bouyant craft in water.

A more specific object of our invention is to provide a novel water jet generator for producing a propulsive thrust on a bouyant craft in the water,-such craft being a ship, barge, boat, canoe or simply a float platform.

Another object of the invention is to provide a novel water jet generator which may be engine powered, or manually actuated in the case of float plaforms, rafts, or other such configurations for recreational sport or exercise.

Other objects and advantages of the present invention will become more apparent from a study of the following description taken with the accompanying drawings wherein.

Figure 1:
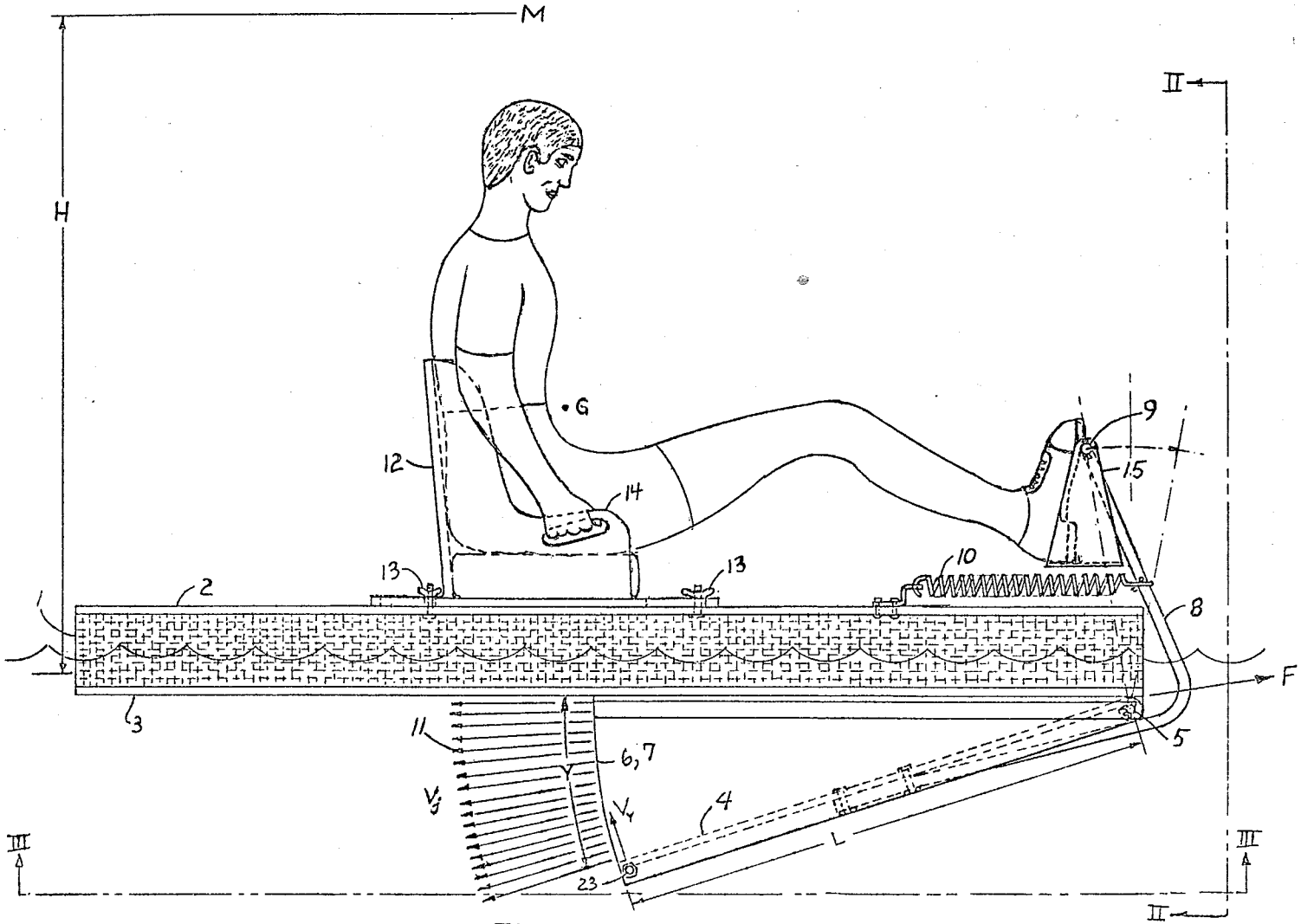
FIG. 1 is an elevational view of a floating platform embodying the principles of our invention.
Figure 2:
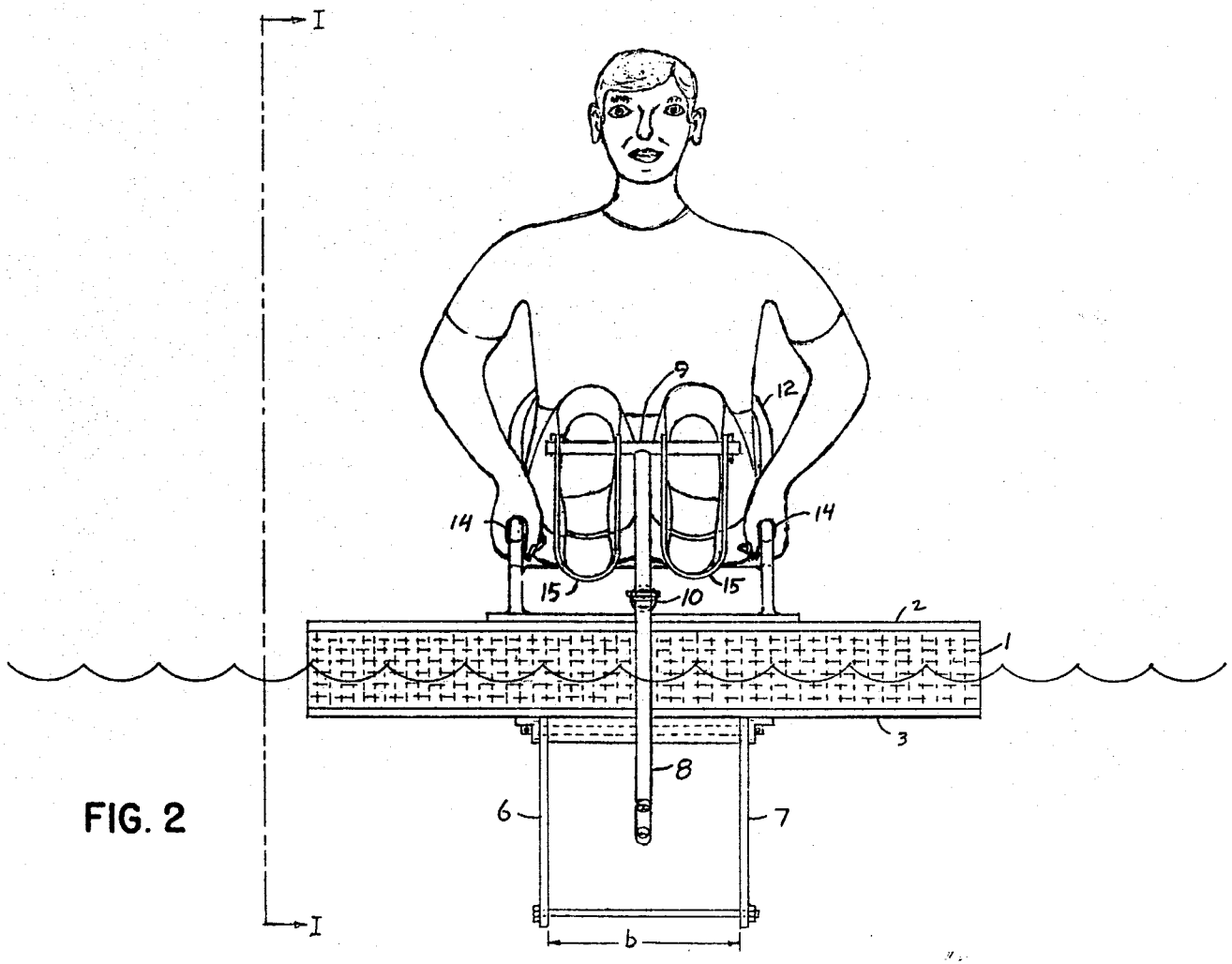
FIG. 2 is a front view taken along line II—II of FIG. 1
Figure 3:
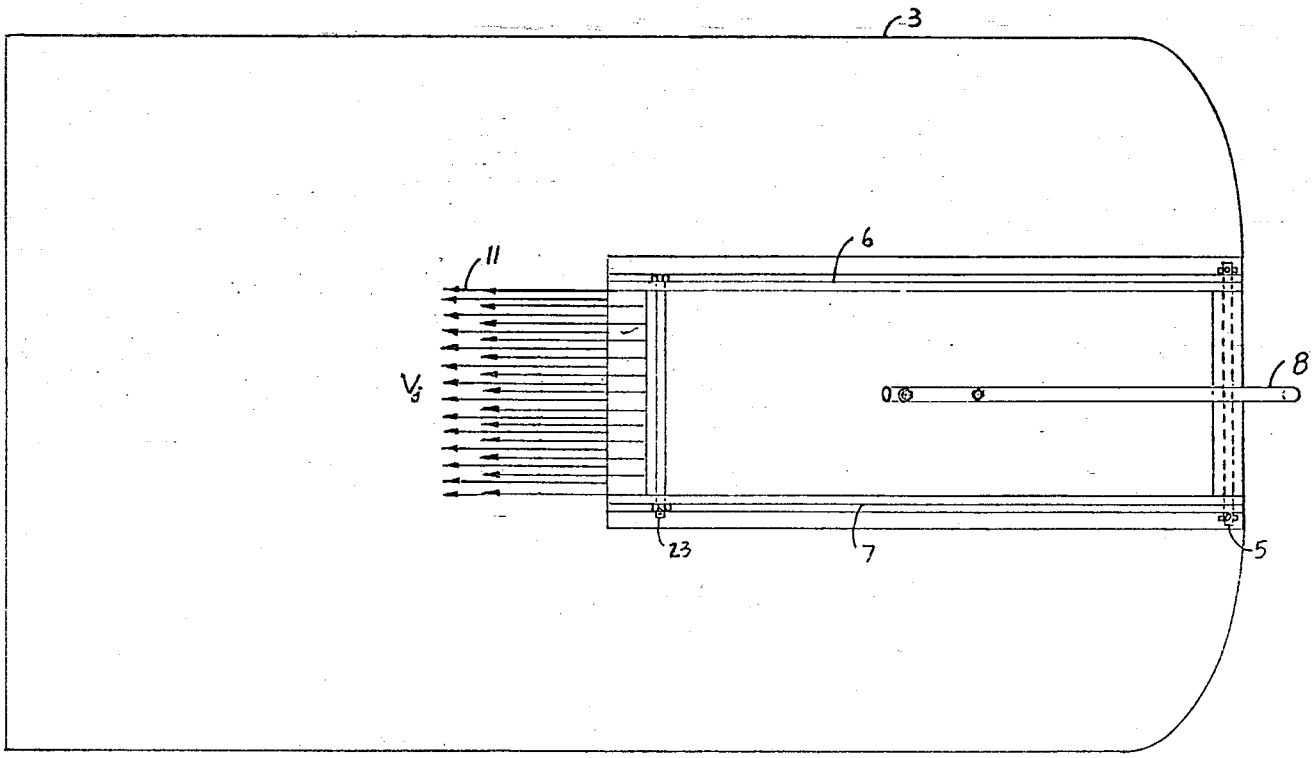
FIG. 3 is a bottom view thereof taken along line III—III of FIG. 1.

Referring more particularly to FIG. 1 to 3 inclusive of the drawing, numeral 1 denotes a flat platform or floatable member made of a low density expanded plastic 1 sandwiched between top and bottom rigid panels 2 and 3, the combination having sufficient volume to support a person sitting on the platform as it floats on the water. The water jet generator is a substantially rigid thin panel 4 that is mounted on the under side of the float and is pivoted at the front end of the float on a hinge shaft 5. The two vertical sides of the wedge shaped volume between the float platform and the hinged panel are closed off with rigid side members 6 and 7 that are attached to the rigid under side panel 3. These side fins allow the pivoted rigid panel 4 to rotate about its front hinge from a position of wide open or maximum wedge shaped volume to a zero or minimum volume as the panel is rotated up till it contacts and becomes parallel to the under side 3 of the float platform.

The rotation of panel 4 about hinge 5 is actuated by a member or extension 8 that is attached to panel 4 and projects at the front end of the platform up to a horizontal cross bar 9. A helical spring 10 holds panel 4 in a normally open position from which it is then moved to the closed position of zero or minimum volume by a forward push on cross bar 9 exerted by the feet and legs of the person sitting on the platform.

As panel 4 moves to the small volume position, it creates a backward flowing concentrated jet of water

11 flowing out of the wedge shaped chamber of the jet generator through the rear opening. The rate of change of momentum of the water discharge represented by this jet produces a forward thrust F for driving the float platform through the water. At the end of the forward stroke, the foot pressure on bar9 is reduced and spring 10 plus the panel weight return the generator panel 4 at a slower velocity during which water flows in through the rear generator opening to refill the wedge shaped volume. The jet thrust is proportional to the square of the jet velocity. Hence, a return of the generator panel 4 to maximum volume, at say $\frac{1}{3}$ of the forward panel speed, will produce a backward thrust on the platform of only 1/9 of the forward thrust, thus giving a large net forward thrust of 8/9 F for one complete cycle of opening and closing of hinged panel 4.

Because of the simple geometry of the jet generator, it is possible to calculate its performance by means of simple hydrodynamics. Referring to FIGS. 1 and 2, let L=length of panel 4, in.

b=breadth of panel 4, in.

y=variable height of rear opening between 4 and 3, in.

Y=maximum or wide open value of y, in.

$V_y$=velocity of y=(dy in a direction normal/dt) to end of panel 4 in/sec.

$V_j$=jet velocity through rear opening, in/sec.

w=water density, lbs./cu. in.

g=acceleration of gravity, in./sec.$^2$

Then, the time rate of change of the wedge shaped volume is $$\tfrac{1}{2} V_y \text{ Lb cu. in./sec.} \tag{1}$$

The water volume per sec. represented by the water jet is $$\text{by } V_j \text{ cu. in./sec} \tag{2}$$

Expressions (1) and (2) are equal for an incompressible fluid, giving:

$$V_j = \tfrac{1}{2} V_y L/y \text{ in./sec} \tag{3}$$

Note that the water jet velocity is independent of the width b of panel 4.

The water mass per second flowing in the jet is $$\frac{dm}{df} = V_j \frac{ybw}{g} = \tfrac{1}{2} V_y \frac{Lbw}{g} \text{ lbs. sec/in.} \tag{4}$$

The resulting forward thrust force F of the water jet on the platform is $$F = V_j \cdot \frac{dm}{dt} = \tfrac{1}{2} V_y \frac{L}{Y} \times \tfrac{1}{2} \frac{LbwV_y}{g} = \tfrac{1}{4} V_y^2 \frac{L^2 bw}{yg} \tag{5}$$

Taking for our system parameters values that are compatible with a person's leg muscular capability, let $L$=36 in., b=12 in, $V_y$=18 in/sec, w=0.036 lbs/cu. in g=386 in/sec.$^2$, then $$F = \frac{1}{4} \times \frac{18^2 \times 36^2 \times 12 \times 036}{386_y} = \frac{117.485 \text{ lbs.}}{y} \quad (6)$$

The variation of F with y is shown in the following table starting with the maximum y=Y=12 in.

TABLE I

| y" | 12 | 11 | 10 | 9 | 8 | 7 | 6 |
|---|---|---|---|---|---|---|---|
| F lbs. | 9.79 | 10.68 | 11.75 | 13.05 | 14.68 | 16.78 | 19.58 |
| y | 5 | 4 | 3 | 2 | 1 | | |
| F | 23.50 | 29.37 | 39.16 | 58.74 | 117.49 | | |

A measure of the capabilities of this jet thruster for driving such a small recreational platform can be obtained by evaluating the forward momentum imparted to the platform by the impulse of the jet force. That is $$\int mdv = \int Fdt \quad (7).$$

The higher values of F at the smaller values of y do not contribute as much to $\int Fdt$ because of the smaller time interval as compared to the longer time intervals over which the smaller values of thrust act. Using Eq (6), the value of the impulse integral is readily obtained:

$$\int Fdt = \int_1^{12} \frac{117.485}{y} \times \frac{dy}{V_y} = \frac{117.485}{Vy} \log y \Big]_1^{12} = \frac{117.485 \times 2.4849}{18} \quad (8)$$

or $\int Fdt = 16.22$ lb-sec.

Since the total jet exit closing time is $y/V_y = 12/18 = \frac{2}{3}$ sec., the average thrust force on the platform is $$F = (16.22/\tfrac{2}{3}) = 24.33 \text{ lbs} \quad (9)$$

This calculation is approximate to the extent that it assumes a constant $V_y$ over the range of y. However, the variation in $V_y$ should not be too great between the values of zero at each end of the stroke of jet panel 4, so that the value of $\overline{F} = 24.33$ lbs fairly represents the forward driving thrust of the jet generator.

If the velocity $V_y$ of the tip of panel 4 on the return stroke is kept at $\frac{1}{3}$ of the forward velocity (2 sec. opening time as compared to $\frac{2}{3}$ sec. closing time), then the backward thrust on the platform is reduced to 1/9th of the forward thrust, giving a net forward average driving thrust of $$\overline{F}\text{ net} = 8/9 \times 24.33 = 21.63 \text{ lbs} \quad (10)$$

An estimate of the platform velocity $V_p$ in the water is obtained by equating the frontal drag of the immersed area of the platform to the above thrust:

For a platform weight of 50 lbs. plus 150 lbs. for the passenger, the depth of immersion of a 42 in wide by 6 ft. long platform is 2 in. The frontal drag area is thus 2×42=84 sq. in., and $$\frac{1}{2} \frac{w}{g} V_p^2 \times 84 = 21.63 \quad (11)$$

$$\text{Or } V_p^2 = \frac{21.63 \times 2 \times 386}{.036 \times 84} = 5522 \text{ in.}^2/\text{sec.}^2$$

-continued $$V_p = 74.3 \text{ in./sec.} = 6.19 \text{ ft./sec.} = 4.22 \text{ mph} \quad (12)$$

This is equivalent to a brisk walking pace, and is about all one can expect from unaided human power. It is sufficient for leisurely exploration of rivers, lakes, and bayous.

In designing the water jet thruster it is necessary to know, in addition to the propulsion thrust F, the force $F_f$ that must be exerted by the feet and legs to maintain $V_y$ and to develop the propulsion thrust. The foot force $F_f$ is the result of a complex distribution of hydraulic pressures within the jet that oppose the closing of the thruster panel 4. However, it is possible to get an accurate evaluation of $F_f$ without knowing the detailed jet pressure distribution over panel 4 by using an energy method that equates the work done by $F_f$ to the kinetic energy of the jet stream, as follows.

On a differential displacement basis, for a displacement dy of the end of panel 4, the work done by the foot force is $$\text{Work input} = C\, F_f dy \quad 12(a)$$

The water mass issuing in the jet per second is given by Eq. (4). Therefore in a time $dt = dy/V_y$, the mass issuing in the jet is $$dm = \frac{1}{2} V_y \frac{Lbw}{g} \times \frac{dy}{V_y} = \frac{1}{2} \frac{Lbw}{g} dy \quad 12(b).$$

The velocity of this mass element being given by Eq (3), its kinetic energy is $\frac{1}{2}$ dm $V^2$j, or $$KE = \frac{1}{2} \times \frac{1}{2} \frac{Lbwdy}{g} \times \frac{1}{4} \frac{Vy^2 l^2}{y^2} = \frac{1}{16} \frac{Vy^2 bwL^3}{g\, y^2} dy \quad 12(c).$$

Setting this equal to the element of work input given by Eq. 12(a). the result is $$cF_f dy = (1/16)\, V_y^2 (bwL^3\, dy/gy^2) \quad 12(d).$$

Or $$F_f = V_y^2\, bwL^3/16Cgy^2 \quad 12(e).$$

In this formula C is the ratio of foot displacement to the displacement y of the end of panel 4. In a typical design, with y=Y=12" the foot displacement might be 6", making $C = \frac{1}{2}$ then $$\frac{F_f V_y^2\, bwL^3}{8gy^2} = \frac{FL}{2y} \text{ lbs} \quad 12(f).$$

For the previously chosen values of $V_y$=18" sec. b=12", L=36", Y=12", the variation of $F_f$ with y is given in Table II below.

TABLE II

| y" | 12 | 11 | 10 | 9 | 8 | 7 | 6 |
|---|---|---|---|---|---|---|---|
| F lbs. | 9.79 | 10.68 | 11.75 | 13.05 | 14.68 | 16.78 | 19.58 |
| $F_f$ lbs. | 14.69 | 17.48 | 21.15 | 26.10 | 33.03 | 43.15 | 58.74 |
| y | 5 | 4 | 3 | 2 | 1 | | |
| F | 23.5 | 29.37 | 39.16 | 58.74 | 117.49 | | |
| $F_f$ | 84.6 | 132.17 | 235 | 529 | 2115 | | |

soft stop at end of stroke.

The rapid increase in the values of $F_f$ near the end of the jet panel displacement means that the assumed velocity of $V_y=18$ in./sec. cannot be maintained by limited foot forces during the last 3 inches of panel displacement. The large hydraulic pressures developed in that interval thus act as a soft stop on the jet panel displacement and cause a rapid decrease in the panel velocity $V_y$ during the approach to a final stop.

An examination of Equations (5) and 12(e) or 12(f) shows however tha it is possible to reduce the foot forces $F_f$ without decreasing the propulsive thrust F by increasing the panel width b and decreasing the panel length L, thus making the use of the craft more comfortable. For example, for $V_y=18$, $b=42$, $L=19.25$ and $Y=12$, the F and $F_f$ are shown in Table III below:

TABLE III

| y | 12 | 11 | 10 | 9 | 8 | 7 | 6 |
|---|---|---|---|---|---|---|---|
| F | 9.79 | 10.68 | 11.75 | 13.15 | 14.68 | 16.78 | 19.58 |
| $F_f$ | 7.85 | 9.35 | 11.31 | 13.96 | 17.66 | 23.07 | 31.41 |
| y | 5 | 4 | 3 | 2 | 1 | | |
| F | 23.50 | 29.37 | 39.16 | 58.74 | 117.49 | | |
| $F_f$ | 44.94 | 70.67 | 125.63 | 282.7 | 1131 | | |
| | | | | soft stop | | | |

Comparing Tables II and III, it is seen that $F_f$ has been cut nearly in half over the entire range of panel displacements in Table III, while the propulsive thrust F is unchanged. This is due to the reduction in Jet kinetic energy by making the product $bL^3$ smaller in Eq. 12(c), while the product $bL^2$ remains unchanged in Eq. (5).

A further reduction in foot force can be effected by increasing the foot travel on cross bar 9. For example, by making the foot and bar displacement 9 inches instead of 6 inches, C in Eq 12(e). is increased from $\frac{1}{2}$ to $\frac{3}{4}$, giving a 33% reduction in the values of $F_f$ listed in Table III. This expedient will not reduce the amount of work performed by the feet and legs, since force times distance is unchanged, but it will make the smaller force times the longer stroke more compatible with human muscular response and comfort.

To provide a fixed reaction base against which to support the boatman as he pushes against cross bar 9, a seat 12 is mounted on the top deck. It is equipped with a back and is adapted to be adjusted fore and aft by means of a slotted base and wing nuts 13 to accomodate different leg lengths. Seat 12 is also provided with hand grips 14 for stable support of its occupant.

To relieve the boatman of the effort of supporting his feet and legs during the return stroke especially, stirrups 15 are hung from cross bar 9 for holding the foot or shoe heels. These stirrups are free to swing on bar 9 and will thus move with the heel without sliding.

The platform may be steered by means of a conventional rudder mounted in the path of the jet stream and connected to a tiller on the upper deck. A more elegant method of steering is to lean in the direction wanted. The increase in the platform immersion on one side with its increased drag force will combine with the jet thrust to produce a moment steering the craft in the leaning direction.

Figure 4:
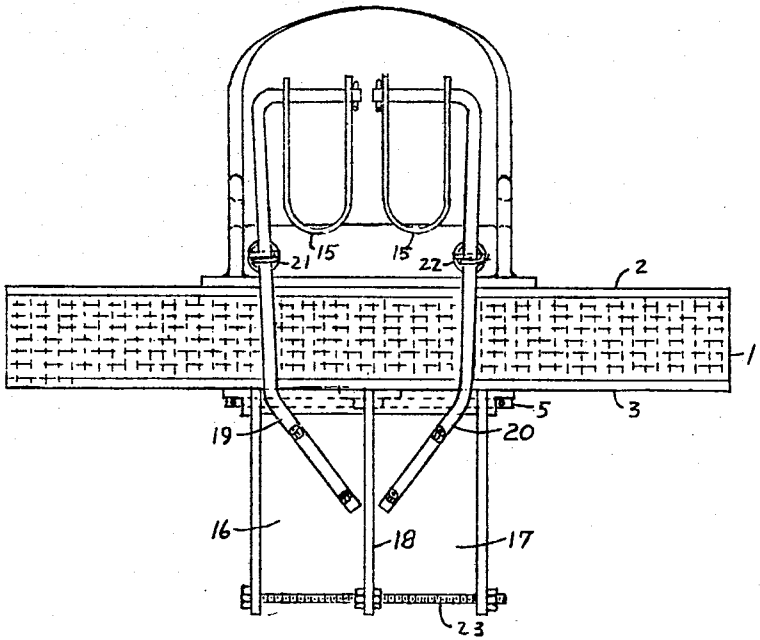
FIG. 4 is a front view of a modification thereof.

Another embodiment of a rudderless platform with even greater steering capability is shown in FIG. 4. There jet generator panel 4 is split up into two separate panels 16 and 17 with a common divider fin 18 at the middle. Each panel is actuated independently with one foot and leg by means of bars 19 and 20 that terminate in foot stirrups 15. Each jet panel is returned to its start position by the panel weight plus the force of return springs 21 and 22. The lower ends of vertical fins 6, 7, and 18 are joined by a bolt connection 23 to prevent spreading of the thin fins by the hydraulic pressures generated in the jet interior.

The embodiment of FIG. 4 has two advantages. One is the ability to steer the craft more effectively by pumping one or the other of the jet panels. The other advantage is that the rider's legs can be moved either together or alternately to provide more variety in the exercise modes.

Figure 5:
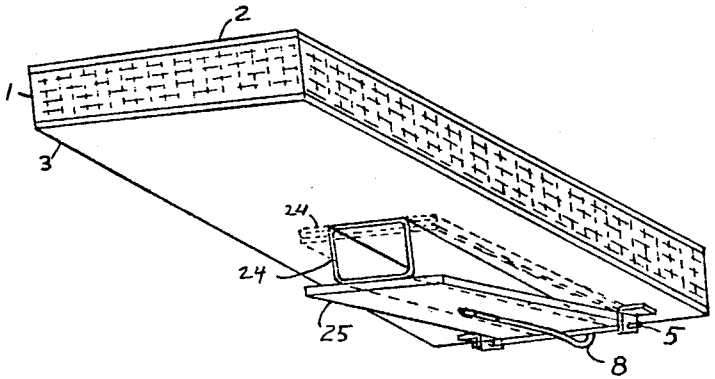
FIG. 5 is a bottom, perspective view of the platform and modified jet generator of FIGS. 1 to 4.

The final embodiment, shown in FIG. 5, does away with the vertical jet fins altogether. Instead, a wedge shaped water volume for jet production is defined by means of a liner 24 made of rubber or other flexible elastomer. This is bonded to the underside of the platform and to the actuating panel 25 that is hinged at the front end. When this panel is moved upward into parallelism with the platform deck, the rubber liner is squeezed down to eject the water jet, until the liner is squeezed flat as shown by the dashed outline in the figure.

In these examples of a recreational vehicle platform, there is one other aspect that needs some analysis and that is the stability of the platform against overturning due to the gravity and buoyancy forces. With a person sitting on the platform, the center of gravity G of the combined system of person+platform is located above the center of buoyancy of the displaced water. In this condition, to insure stability against overturning, the metacenter M must be above the center of gravity G. Referring to FIG. I, the metacenter M represents the point at which the resultant vertical buoyant force of a tilted platform intersects the centerline of the platform+person system. H is given by the well known formula:

$$H=I/V \text{ in.m} \tag{13}$$

where

I=moment of inertia of the areas on the waterline section, and V=displaced volume in the water.

For a unit length of platform, $$I = 2\int_{o}^{\frac{B}{2}} X^2 dx = \frac{B^3}{12} \tag{14}$$

if B is the platform width.

Since V=hB if h is the submerged depth of the platform, then $$H = \frac{B^3}{12hB} = \frac{B^2}{12\,h} \tag{15}$$

In our example, for B=42 in and h a maximum of 3 in, $$H=42^2/12\times 3=49 \text{ in.}$$

The system is adequately stable, since the distance from the level center of buoyancy to the cg at G is only about 16 in.

Thus it will be seen that we have provided a highly efficient jet propulsion chamber for a buoyant craft which enables a greater distance of travel for the exertion of a given manual force because of the high efficiency of the wedge shaped chamber.

While we have illustrated and described several embodiments of our invention, it will be understood that these are by way of illustration only and that various changes and modifications are contemplated within the scope of the following claims.

We claim:

1. A buoyant craft including a floatable member, a seat supported on said floatable member, means for developing a water jet thrust to propel said floatable member comprising a pair of wedge shaped chambers, attached to the bottom surface of said floatable member, in the form of integral and separate liners of a flexible elastomer having openings extending through the entirety of the large ends of said chambers, actuating panels pivotally connected to said floatable member and having extensions projecting upwardly of the front end of said floatable member, return springs connecting said extensions to said floatable member at a point forward of said seat, a pair of pedals mounted on said extensions and in operative engagement with said wedge shaped chambers so as to effect jet action by complete collapsing of said chambers towards the underside of said floatable member against the action of said springs, said chambers being opened by the aid of said springs for quick and free intake of water, said pedals each independently operating one of said chambers to enable steering as well as propulsion of said craft.

* * * * *